US005811746A

United States Patent [19]

Noritake

[11] Patent Number: 5,811,746

[45] Date of Patent: Sep. 22, 1998

[54] CAM SWITCH MECHANISM

[75] Inventor: Seiichirou Noritake, Nagano, Japan

[73] Assignee: Sankyo Seiki Mfg. Co., Ltd., Nagano-ken, Japan

[21] Appl. No.: 622,737

[22] Filed: Mar. 27, 1996

[30] Foreign Application Priority Data

Jan. 11, 1996 [JP] Japan ..... 8-003157

[51] Int. Cl.[6] ..... H01H 43/00

[52] U.S. Cl. ..... 200/38 R; 200/35 R; 200/38 B

[58] Field of Search ..... 200/33 R–40, 200/35 R, 38 R, 38 B, 38 C, 38 CA, 38 DA; 307/112–150, 139, 140, 141, 141.4, 141.8

[56] References Cited

U.S. PATENT DOCUMENTS 4,187,499 2/1980 Scheer ..... 340/309.1
4,362,953 12/1982 Bolin ..... 307/141
4,370,566 1/1983 Perry et al. ..... 307/141
4,521,722 6/1985 Barthel et al. ..... 200/38 B X
4,599,499 7/1986 Duve ..... 200/35 R
4,743,820 5/1988 Veach ..... 200/38 B X
4,755,635 7/1988 Willigman ..... 200/35 R
5,182,461 1/1993 Baran ..... 307/139 X

*Primary Examiner*—J. R. Scott
*Attorney, Agent, or Firm*—McAulay Fisher Nissen Goldberg & Kiel, LLP

[57] ABSTRACT

A cam switch mechanism comprises a drive source, such as a motor, a cam driven by the drive source, a switching device responsive to contacting the cam surface of the cam for switching its electrically conducting state and a control unit, such as a microcomputer, for controlling the drive source. Control of the drive source by the control unit makes it possible to set positions of the cam as desired and permits the electrically conducting state of the switching means to be freely set. The control unit controls the drive direction, stopping and drive speed of the drive source.

4 Claims, 18 Drawing Sheets

| WASH MODE | TIME | PRE-WASH | WASH | RINSE | HEATER |
|---|---|---|---|---|---|
| HOT-SCRUB | 107 min. | 4 + 4 + 5 | 43 | 4 + 4 + 8 | 35 |
| NORMAL WASH | 86 min. | 8 + 5 | 22 | 4 + 8 + 8 | 35 |
| SHORT WASH | 78 min. | 5 | 22 | 4 + 4 + 8 | 35 |
| RINSE & HOLD | 12 min. | | | 4 + 8 | |
| PLATE WARMER | 35 min. | | | | 35 |

FIG. 7

CAM SWITCH MECHANISM

BACKGROUND OF THE INVENTION a) Field of the Invention

This invention relates to a cam switch mechanism suitable for controlling automatic dishwashers, etc.

b) Description of the Related Art

Automatic dishwashers can automatically wash dishes, etc., by conducting processes such as wash, rinse, and heat, etc., for specific periods of time, according to the selected course. Cam switch mechanisms are built into these automatic dishwashers, and the execution of each process is controlled by making a plurality of cams, provided so as to correspond with the processes, turn together.

With the conventional cam switch mechanism, the automatic washing program is made to correspond from beginning to end with one cycle of each cam. In the cam surface of each cam, a protrusion is formed only in the region wherein, out of all the automatic washing programs, only the corresponding process is performed, and the proportion of the entire cam surface length occupied by this region corresponds to the shortness or length of the time that each process is performed. In other words, for processes that are performed over a long time period, the protrusion region is formed broadly, while, conversely, for processes that are completed in a short period of time, the region is formed narrowly. The turning speed of the cams is constant, and when the cams make one cycle, the automatic washing terminates.

With the conventional cam switch mechanism, when a short-duration process is set, the protrusion on the cam surface which performs the switching operation is small, resulting in poor timing precision when performing on-off operations. Not only that, but the small protrusions on the cam surface easily become worn over time, and precision deteriorates markedly even with a slight amount of wear.

On the other hand, in order to improve the timing precision of the on-off operations, it is well to perform the control directly by means of a computer instead of controlling by means of a cam switch mechanism. Computers, however, are weak electrical systems, requiring expensive power relays for them to directly control each process, resulting in higher production costs.

OBJECT AND SUMMARY OF THE INVENTION

The primary object of this invention is to provide a cam switch mechanism that can improve the timing precision of each process control, while holding down the rise in production costs.

In accordance with the invention, a cam switch mechanism comprises a drive source, a cam driven by the drive source, switching means responsive to contacting the cam surface of the cam for switching its electrically conducting state and a control unit for controlling the drive source. Control of the drive source by the control unit makes it possible to set positions of the cam as desired and permits the electrically conducting state of the switching means to be freely set.

BRIEF DESCRIPTION OF THE DRAWINGS

FIG. 6 presents a diagram which shows the timing with which the cams in the cam switch mechanism depicted in FIG. 1 turn the switching means on;

FIG. 7 presents a diagram which indicates the particulars of the modes for the automatic dishwasher into which the cam switch mechanism depicted in FIG. 1 is built;

FIG. 17 presents a diagram which shows the timing with which the cams in the cam switch mechanism depicted in FIG. 12 turn the switching means on.

DESCRIPTION OF THE PREFERRED EMBODIMENTS

Figure 1:
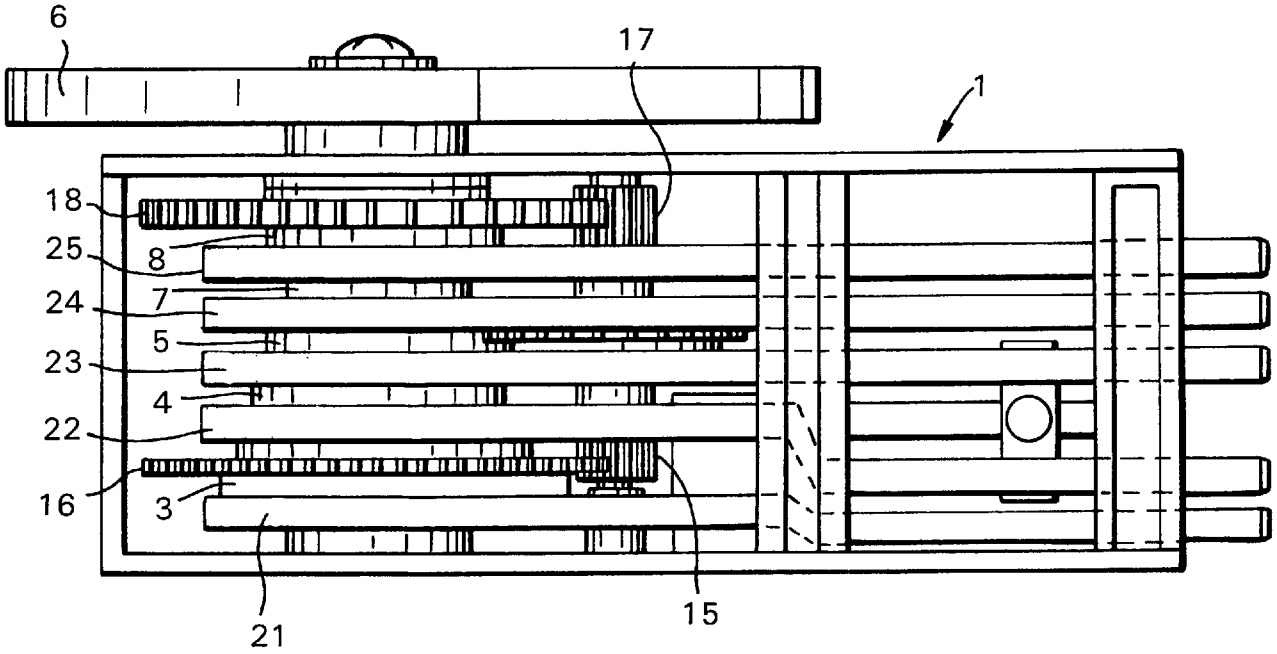
FIG. 1 illustrates a front elevation depicting one example of an embodiment for the cam switch mechanism to which this invention pertains.
Figure 1A:
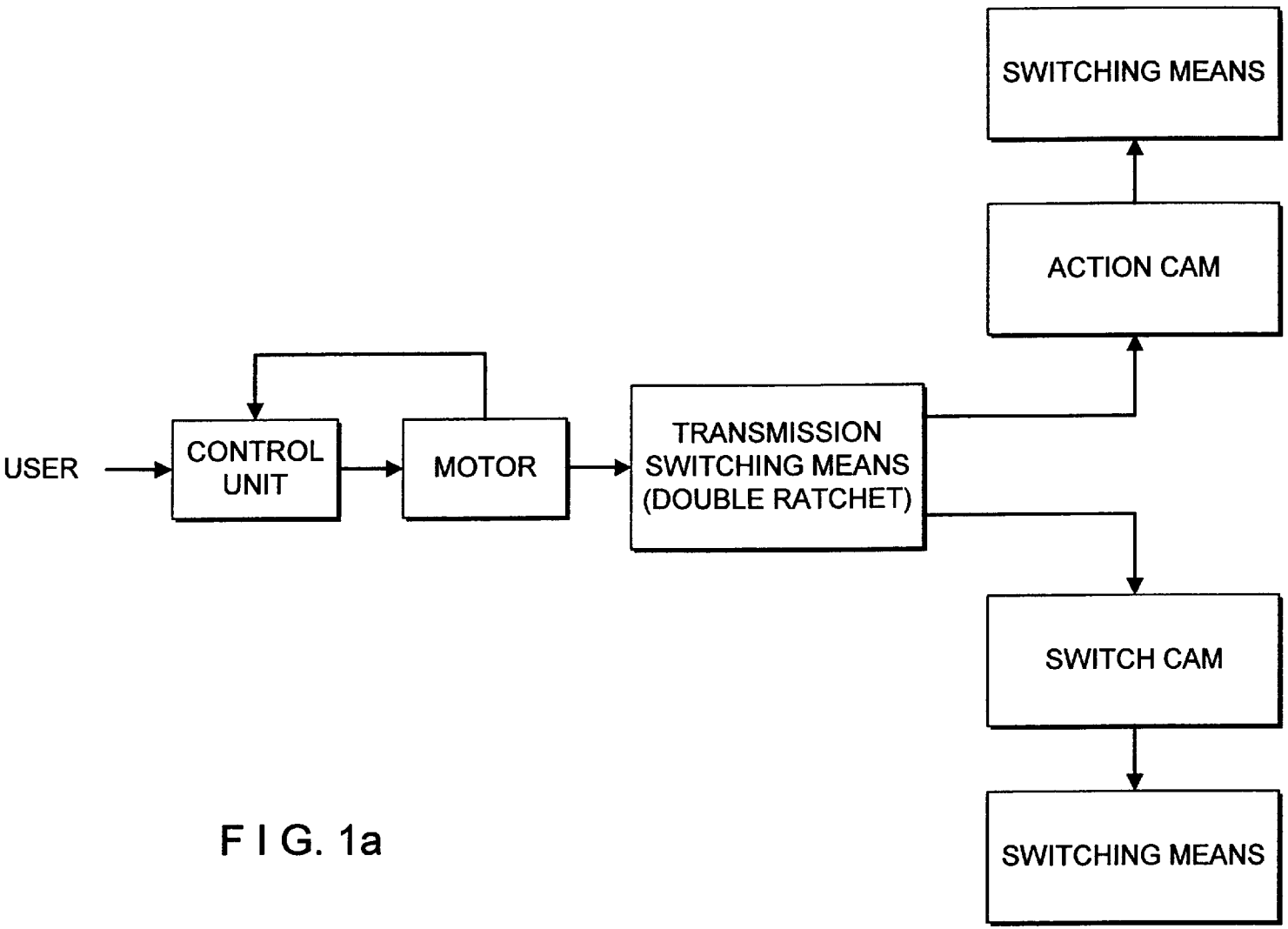
FIG. 1*a* is a block diagram illustrating various features of an embodiment for the cam switch mechanism such as the control unit, motor, double ratchet, etc.
Figure 2:
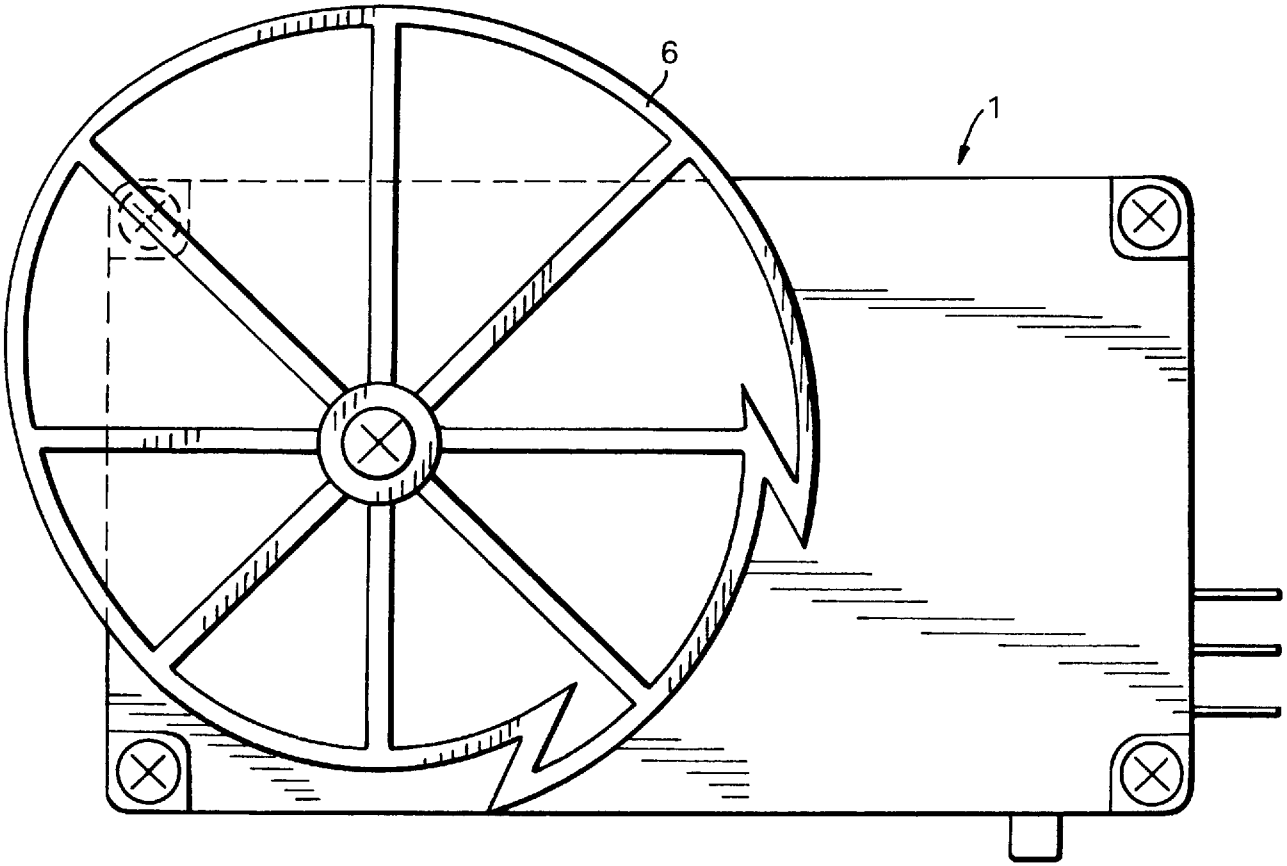
FIG. 2 shows a plan view of the cam switch mechanism depicted in FIG. 1.
Figure 3:
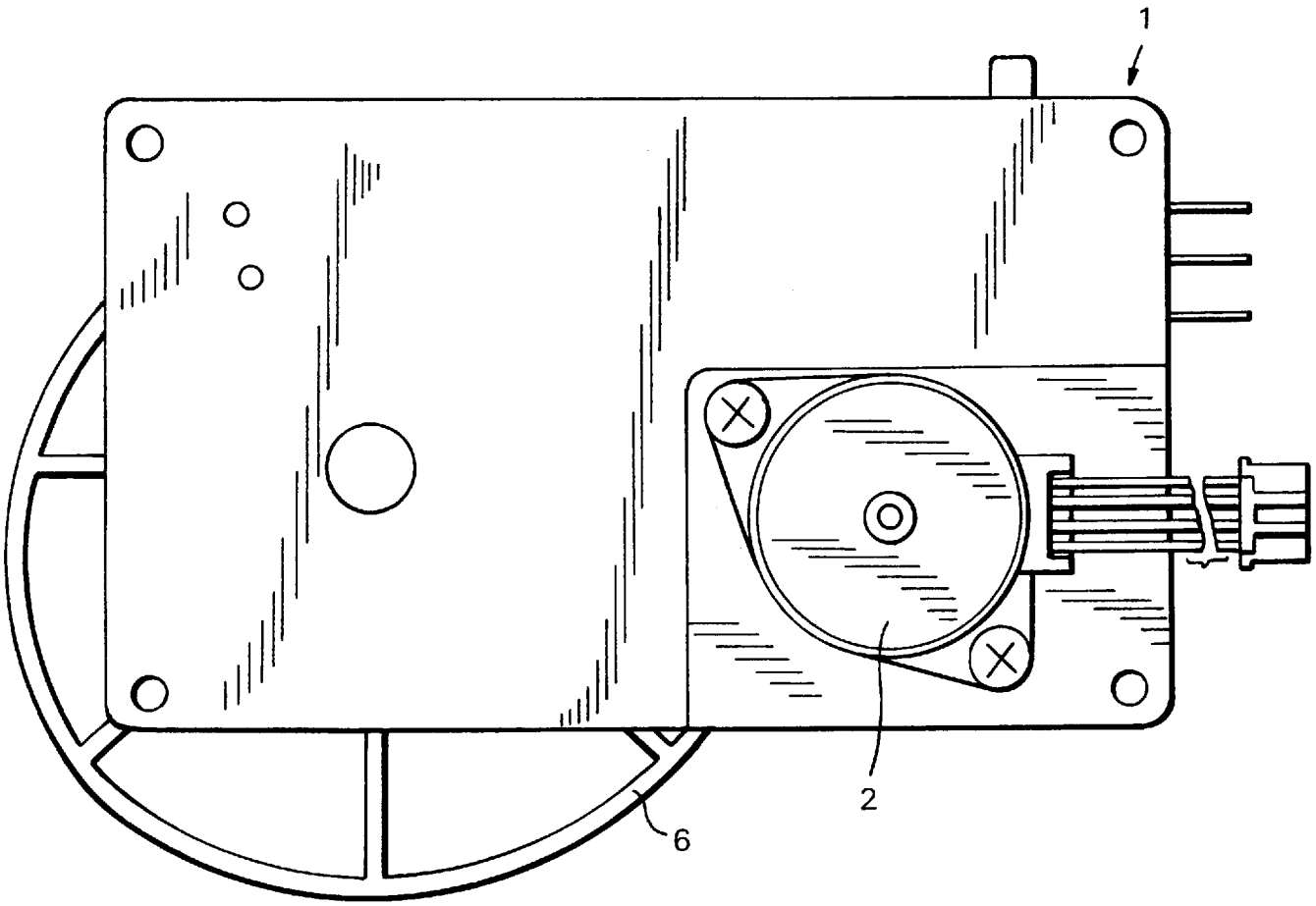
FIG. 3 illustrates a bottom view of the cam switch mechanism depicted in FIG. 1.
Figure 4:
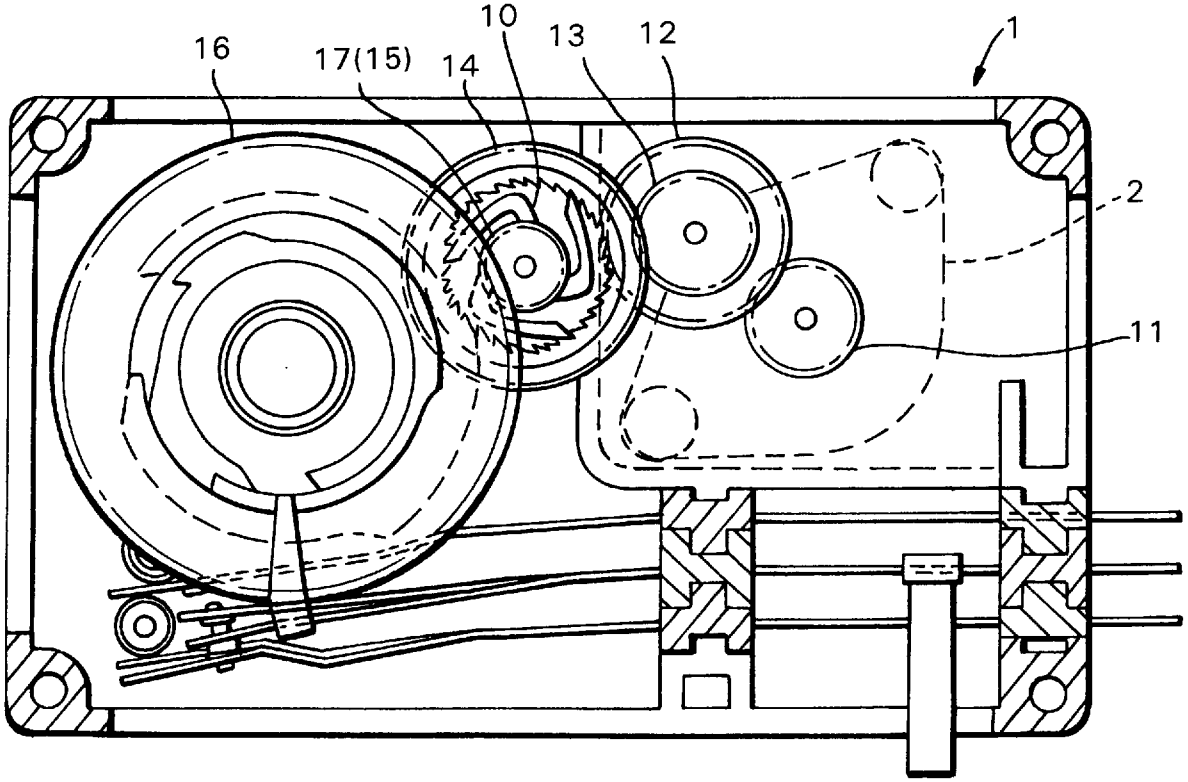
FIG. 4 illustrates a diagram that indicates the positioning of the gears in the cam switch mechanism depicted in FIG. 1.
Figure 5:
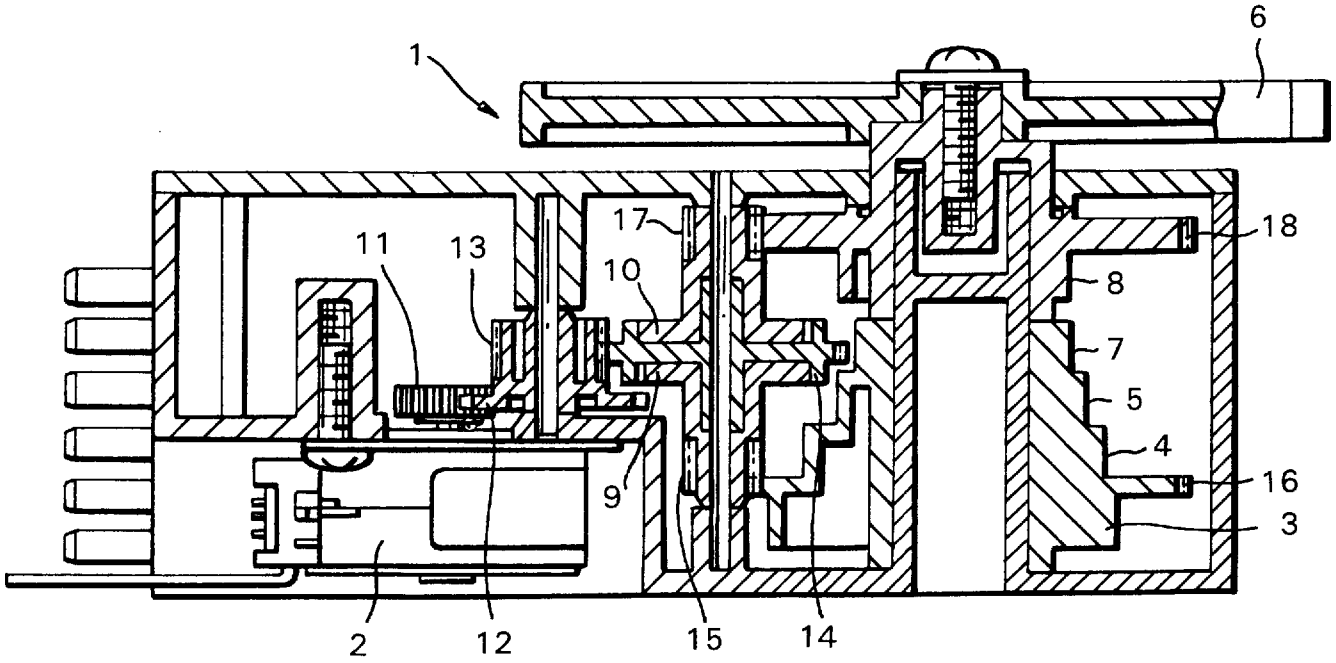
FIG. 5 illustrates a cross-sectional view of the cam switch mechanism depicted in FIG. 1.

The embodiments of this invention will now be described in detail.

FIGS. 1–5 depict one embodiment of the cam switch mechanism to which this invention pertains. This cam switch mechanism 1, for example, is built into an automatic dishwasher; it comprises a motor 2 that is the drive source, cams 3–8 which are driven by the aforementioned motor 2 and have uneven parts (cam surfaces) of specified shapes, switching means 21–25 that slide against the uneven parts of aforementioned cams 3–8 and thereby switch on and off, and a control unit that controls the motor 2. The drive, stopping, and drive speed of the motor 2 are controlled by the aforementioned control unit to set freely the period of time during which the aforementioned switching means is turned on or off. The motor 2 is, for example, a stepping motor. Accordingly, the speeds at which the cams turn are variable, and they can be turned forward and backward.

The actions exhibited by an automatic dishwasher include a fill (hold water—FILL) action, a pump (spray water—PUMP) action, a drain (discharge water—DRAIN) action, and a heater (drying—HEATER) action. The cam switch mechanism 1 executes these actions, either individually or in combination.

The cams include, for example, three switch cams 3—5, one detergent cam (action cam) 6, and two home cams 7 and 8. The first switch cam 3 corresponds to the fill action and drain action of the automatic dishwasher. The second switch cam 4 corresponds to the pump action. The third switch cam 5 corresponds to the heater action. These three switch cams 3–5 are formed integrally together with the first home cam 7 and turn as one unit. The first home cam 7 detects the home position for each of the switch cams 3–5. Also, the detergent cam 6 controls the detergent deploying timing and the rinse deploying timing of the automatic dishwasher. The second home cam 8 detects the home position of the detergent cam 6.

These cams 3–8 are turned by the stepping motor 2. The turning of the stepping motor 2 is transmitted to a first clutch 9 and a second clutch 10 via a first gear 11, a second gear 12, a third gear 13, and a fourth gear 14. The two clutches 9 and 10 have pawls which convey the turning force only in constant and opposite directions, respectively.

The clutches 9 and 10 and the fourth gear 14 are combined on the same shaft to configure a double ratchet mechanism. When the stepping motor 2 is turned forward, the turning force thereof is transmitted to the first clutch 9, whereas when the stepping motor 2 is turned in reverse, this turning force is transmitted to the second clutch 10.

The turning of the first clutch 9 is transmitted to each of the switching cams 3–5 via the gear 15 and the gear 16. Meanwhile, the turning of the second clutch 10 is transmitted to the second home cam 8 via the gear 17 and the gear 18. This second home cam 8 and the detergent cam 6 are made into a single unit with a screw.

In other words, the cam switch mechanism 1 to which this invention pertains has a double ratchet mechanism, that is, a transmission switching means, between the motor 2 and the switch cams 3–5 and detergent cam 6. While separating the switch cams 3–5 and the detergent cam 6, the cam switch mechanism links one ratchet of the double ratchet mechanism to each of the switch cams 3–5, and the other ratchet to the detergent cam 6, respectively, turning the switch cams 3–5 when the motor turns forward, and turning the detergent cam 6 when the motor 2 turns in reverse.

Furthermore, the second gear 12 is formed integrally with the third gear 13, the first clutch 9 with the gear 15, and the second clutch 10 with the gear 17.

Figure 6:
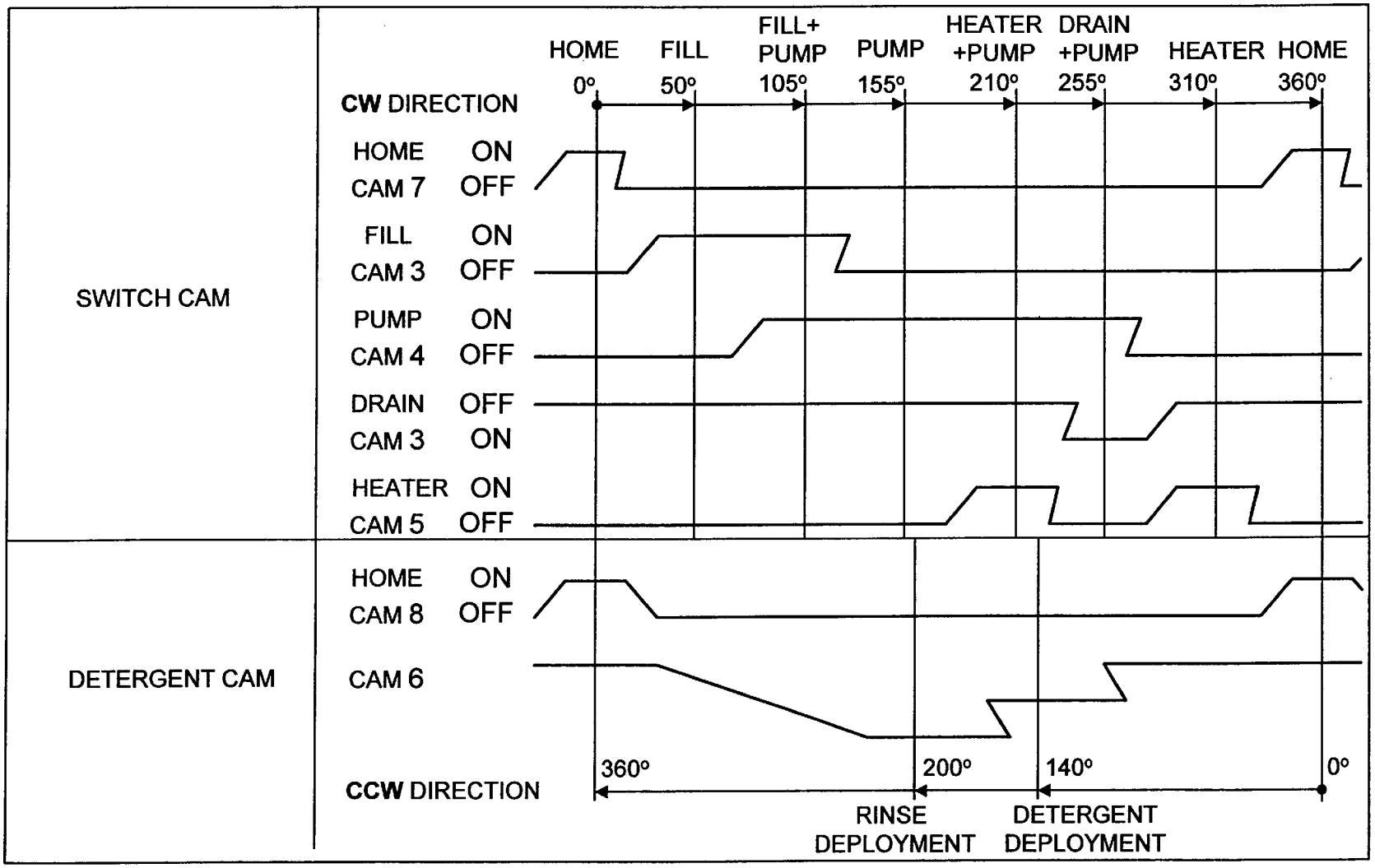

On the cam surfaces of the cams 3–8, the functions noted in FIG. 6 are allocated over the entire 360° cycle of the cam surfaces.

The switching means 21–25 are, for example, leaf switches which are turned on by the elastic deformation of a plate. Each of the switching means 21–25 is turned on by sliding against either a depression or protrusion in the cam surfaces of the switch cams 3–5 and the home cams 7 and 8, and are each turned off by sliding against the other.

Figure 10:
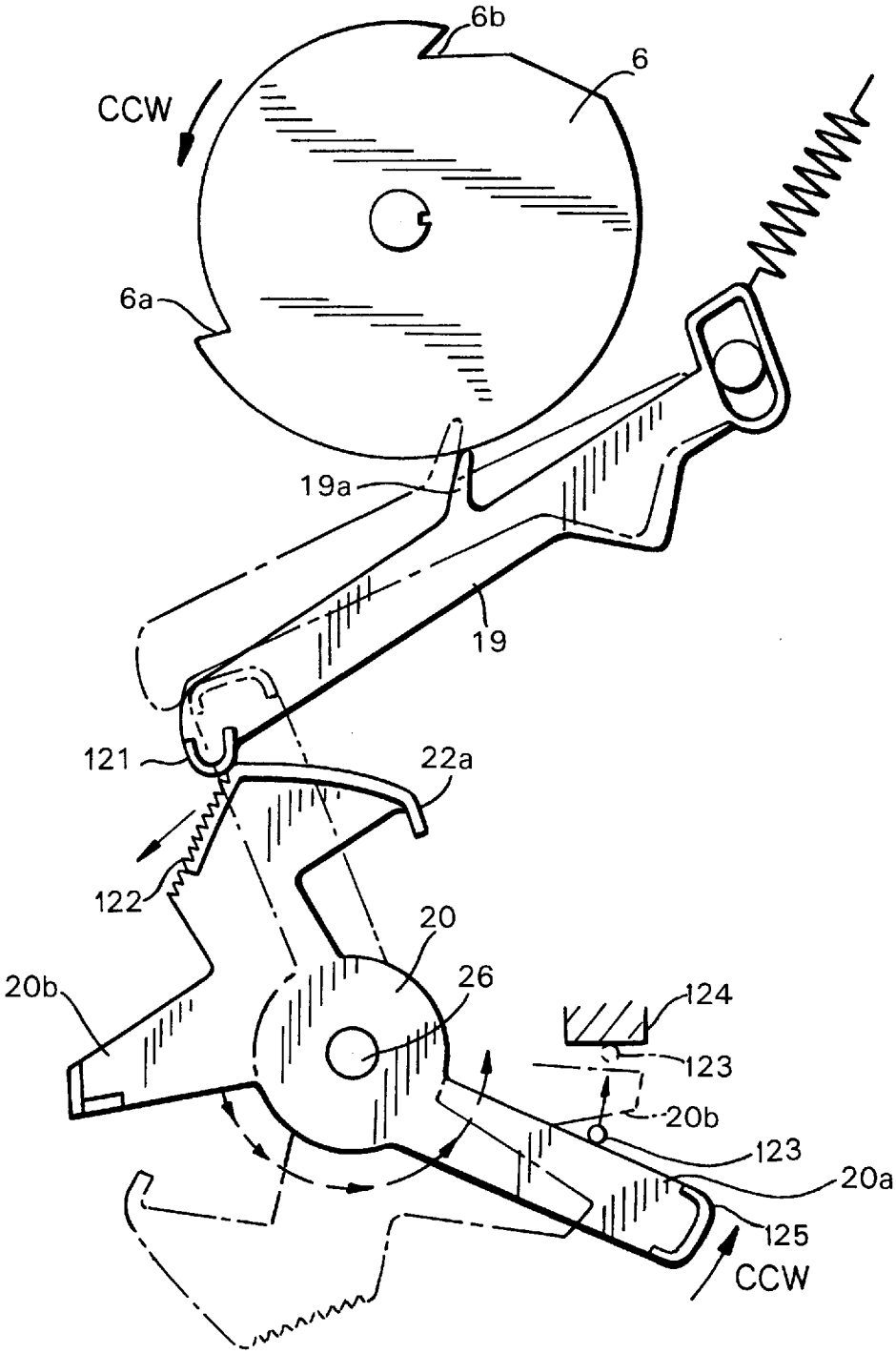
FIG. 10 illustrates a plan view which depicts the stop lever and detergent lever of an automatic dishwasher into which the cam switch mechanism depicted in FIG. 1 is built.

Meanwhile, the detergent cam 6, as depicted in FIG. 10, controls the detergent deployment timing and the rinse deployment timing via action members, i.e. via a stop lever 19 and a detergent lever 20. The detergent lever 20 is spring-loaded in the counter- clockwise (CCW) direction.

More specifically, when due to the detergent wait state indicated by the solid lines in FIG. 10, the detergent cam 6 turns so that the arm 19*a* of the stop lever 19 drops to the drop position 6*a* of the cam 6, an engagement piece 121 in the stop lever 19 separates from an engagement piece 122 in the detergent lever 20; the detergent lever 20 turns in the CCW direction so that the arm 20*a* of the detergent lever 20 engages the engagement piece 121, thereby starting the rinse deployment wait state.

Figure 11:
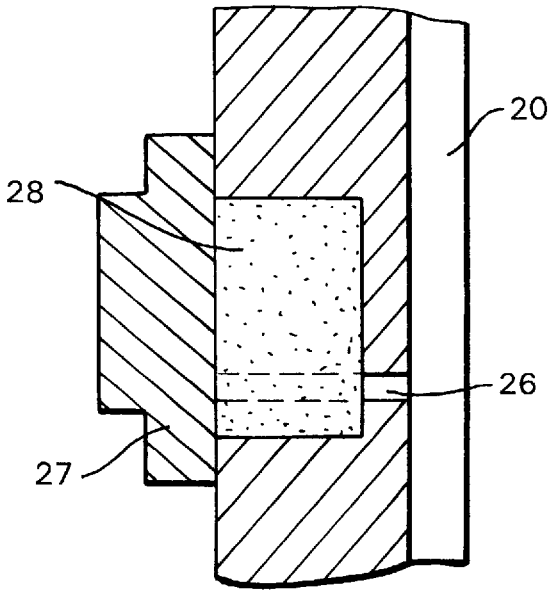
FIG. 11 shows a cross-sectional view that depicts the detergent deployment mechanism in an automatic dishwasher into which the cam switch mechanism depicted in FIG. 1 is built.
Figure 12:
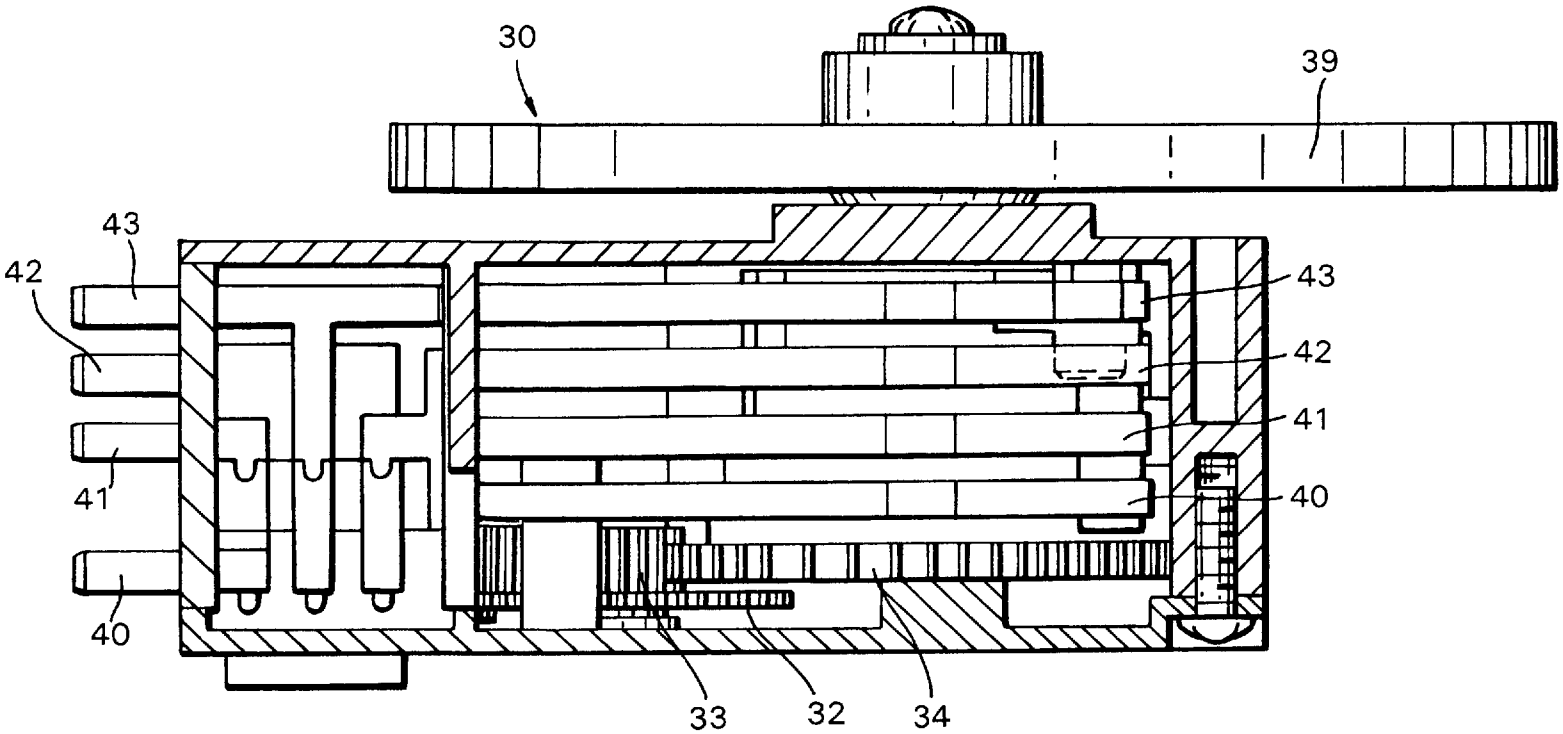
FIG. 12 shows a cross-sectional view which depicts another embodiment for the cam switch mechanism to which this invention pertains.
Figure 13:
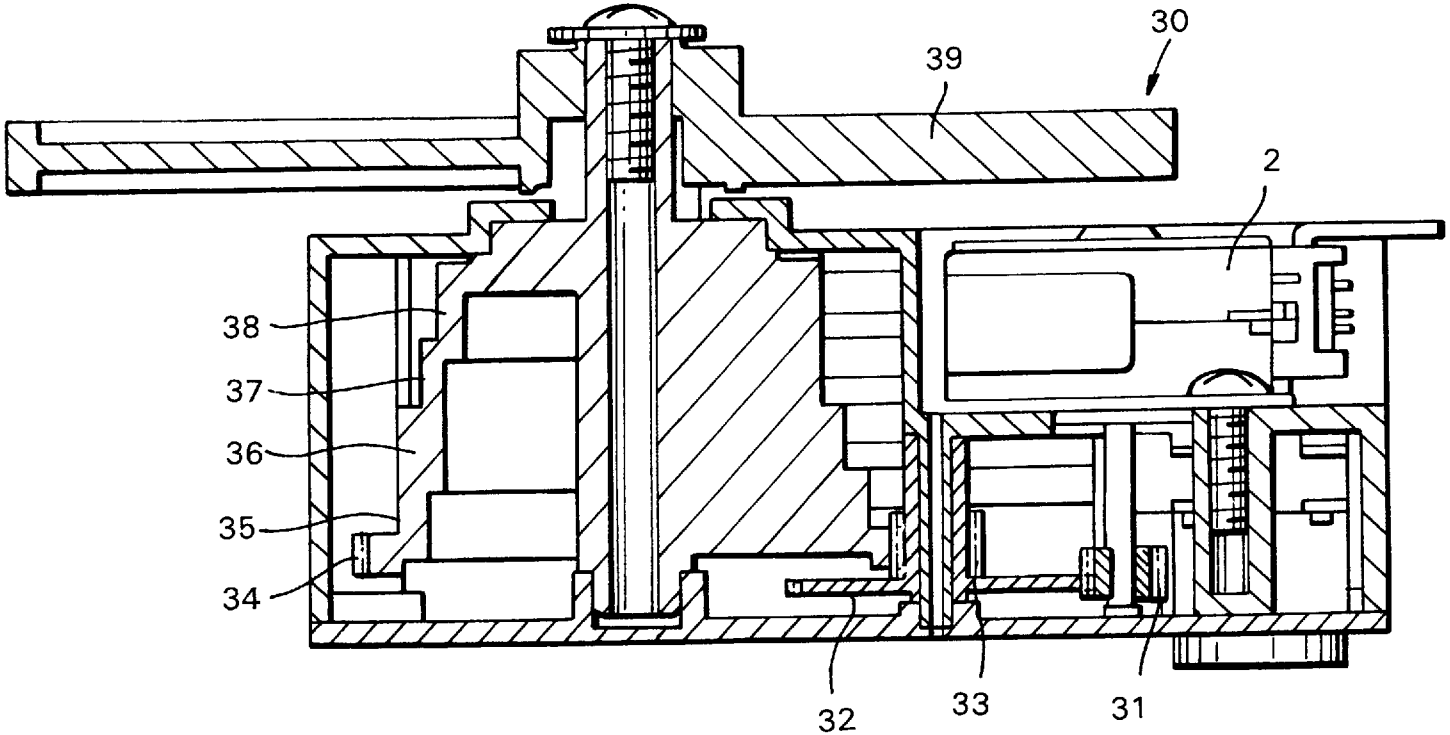
FIG. 13 shows a cross-sectional view of the cams in the cam switch mechanism depicted in FIG. 12.
Figure 14:
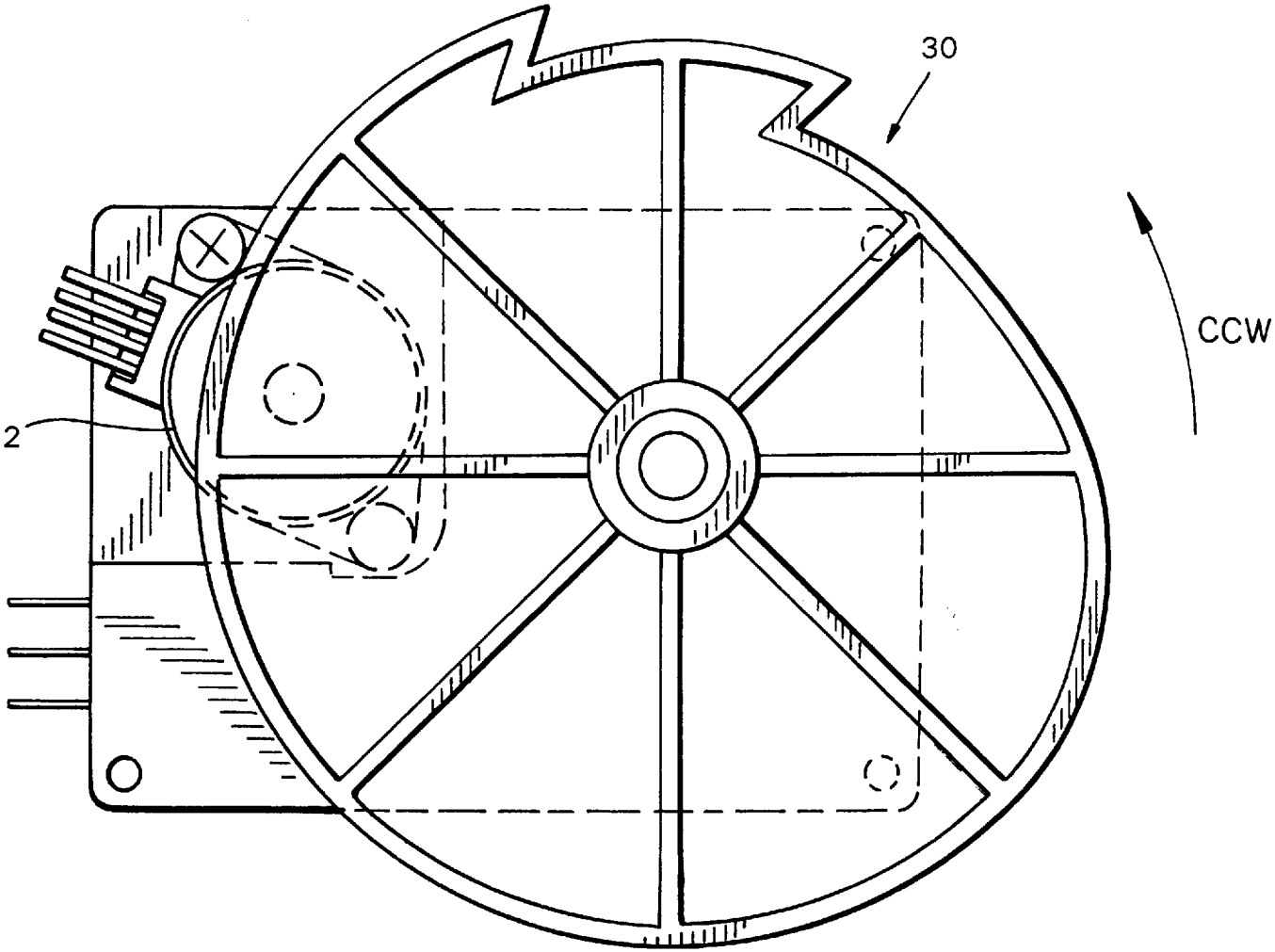
FIG. 14 shows a plan view of the cam switch mechanism depicted in FIG. 12.
Figure 15:
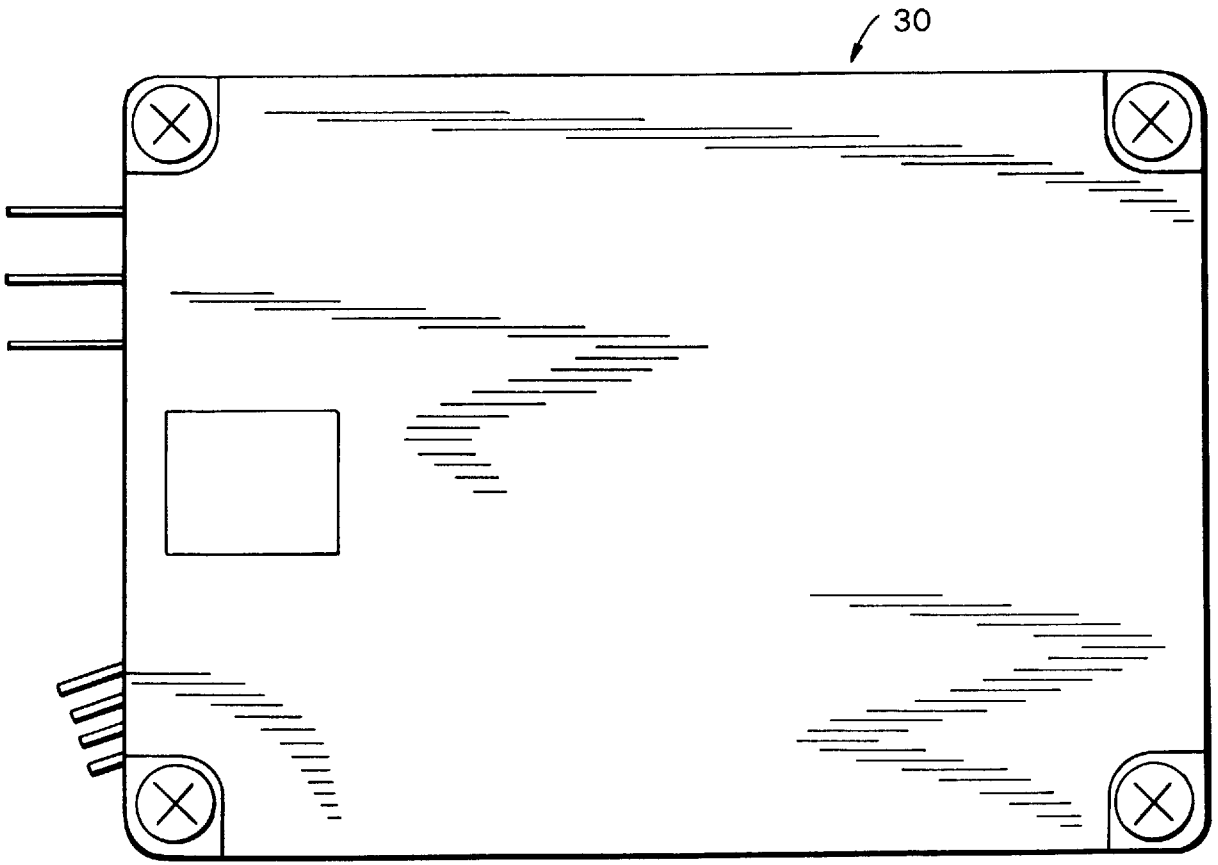
FIG. 15 illustrates a bottom view of the cam switch mechanism depicted in FIG. 12.
Figure 16:
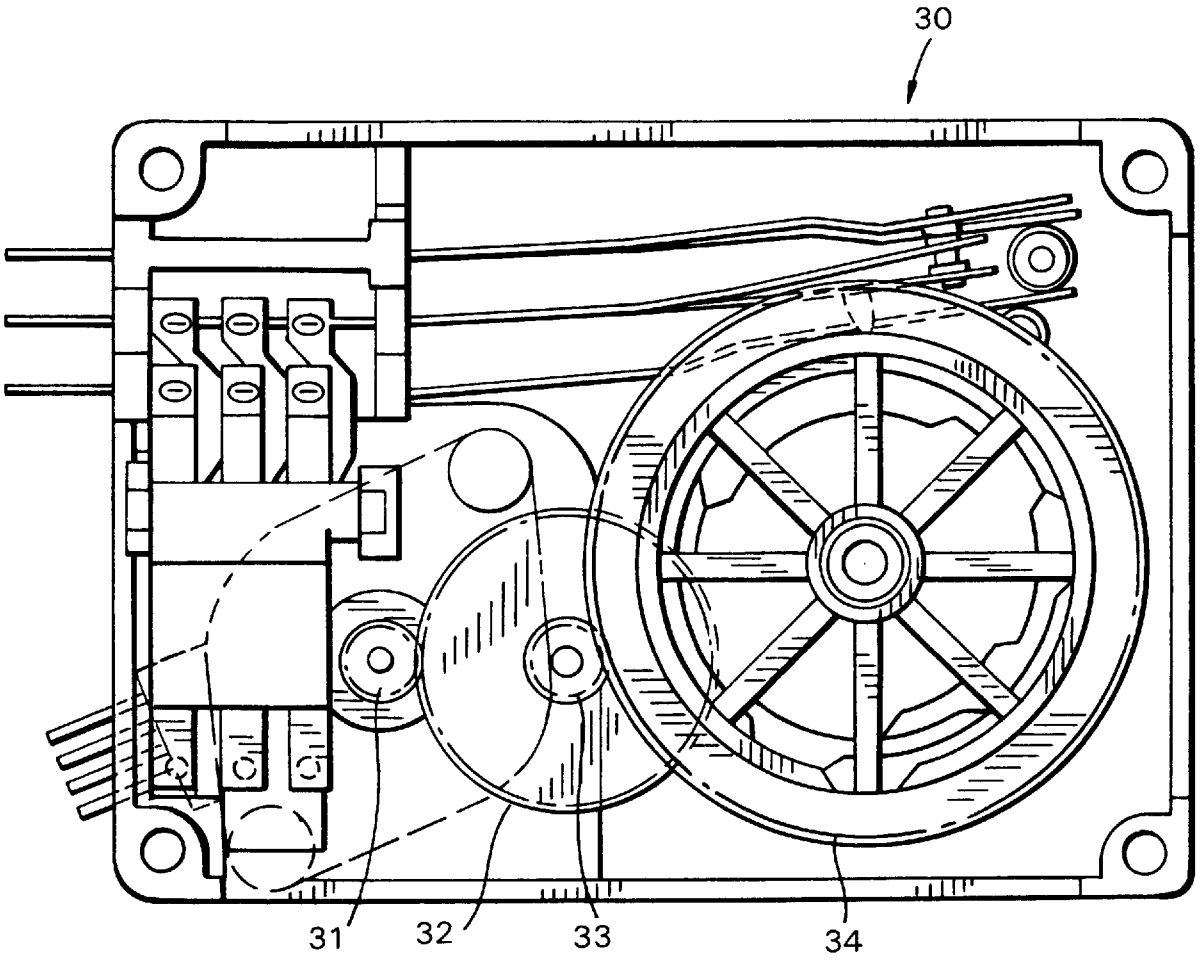
FIG. 16 shows a diagram that indicates the positioning of the gears in the cam switch mechanism depicted in FIG. 12.

At this time, the detergent (not indicated in the drawings) is deployed. To explain the workings of detergent deployment with reference to FIG. 11, the detergent lever 20 turning shaft 26 and the detergent deployment hatch 27 are engaged. Now, when the detergent lever 20 reaches the position indicated in FIG. 10 by the double-dotted broken lines, the detergent deployment hatch 27 swings to open due to the turning of the turning shaft 26, and the detergent 28 is deployed.

Further, when the detergent cam 6 turns in the CCW direction, and the arm 19*a* of the stop lever 19 drops to the rinse drop position 6*b* of the cam 6, the engagement between the engagement piece 121 of the stop lever 19 and the stopper 125 of the detergent lever 20 is broken, the detergent lever 20 turns in the CCW direction, the arm 20*b* of the detergent lever 20 pushes a rinse lever 123 to the stopper 124 of, and rinse deployment ensues.

After rinse deployment, the detergent cam 6 turns further in the CCW direction, reaching the state where it is stopped in the home position. When the dishwasher is used the next time, from this state, the detergent lever 20 is turned in the CW direction manually and the mechanism is reset.

Here, innovative measures are implemented so that there is no contact between either the engagement piece 121 and engagement piece 122, or the engagement piece 121 and stopper 125, when the detergent lever 20 is turned in the CW direction.

More specifically, when the detergent lever 20 is turned in the CW direction, the stop lever 19 is in the solid-line position in FIG. 10, so that the stopper 125 passes outside the engagement piece 121. Also, since the righthand end 22*a* of the engagement piece 122 has a gradually sloping shape, when the detergent lever 20 is manually turned in the CW direction, the engagement piece 121 gently rides over the end 22*a*, so that the detergent lever 20 turns smoothly, without letting the engagement pieces 121 and 122 collide.

FIG. 6 indicates the positioning of the cam surfaces in the cams 3–8, the functions corresponding to each cam surface combination, and the timing of wash and rinse deployment.

HOME indicates that the cam 7 is in the home position, with the switching means 24 in the turned-on state. FILL is the function of filling up with water, with the switching means 21 in the turned-on state due to the cam 3. FILL+PUMP is the function whereby water is sprayed while filling with water, with the state in which the switching means 22 is turned on by the cam 4 added to the FILL function. PUMP is the function which performs only water spraying, continuing the ON state of the switching means 22. With HEATER+PUMP, the state in which the switching means 23 is turned on by the cam 5 is added to the PUMP function, so it is the function which sprays water while heating. With DRAIN+PUMP, the state in which the switching means 21 touches the reverse contact due to the cam 3 is added to the PUMP function, so it is the function which sprays while discharging water. HEATER is the function which performs drying by heating, with the switching means 23 in the turned-on state due to the cam 5.

Moreover, the FILL and DRAIN functions are set so that, if the switching means 21 contacts the protrusion in the cam 3 and touches the contact on one side to turn on, the FILL function is activated, and if the switching means 21 contacts the depression in the cam 3 and touches the contact on the other side to turn on, the DRAIN function is activated, whereas when the switching means 21 is between the two contacts, both of these functions are turned off. However, to facilitate ease of explanation, the representation in FIG. 6 is divided between FILL and DRAIN.

The turning of the motor 2 is controlled by a control unit (not shown in the drawings) such as a microcomputer. The control unit varies the turning, stopping, and turning speed of the motor 2, and freely sets the times during which the switching means 21–25 are turned on and turned off, respectively. This control unit also doubles as the control unit for the automatic dishwasher.

Figure 8:
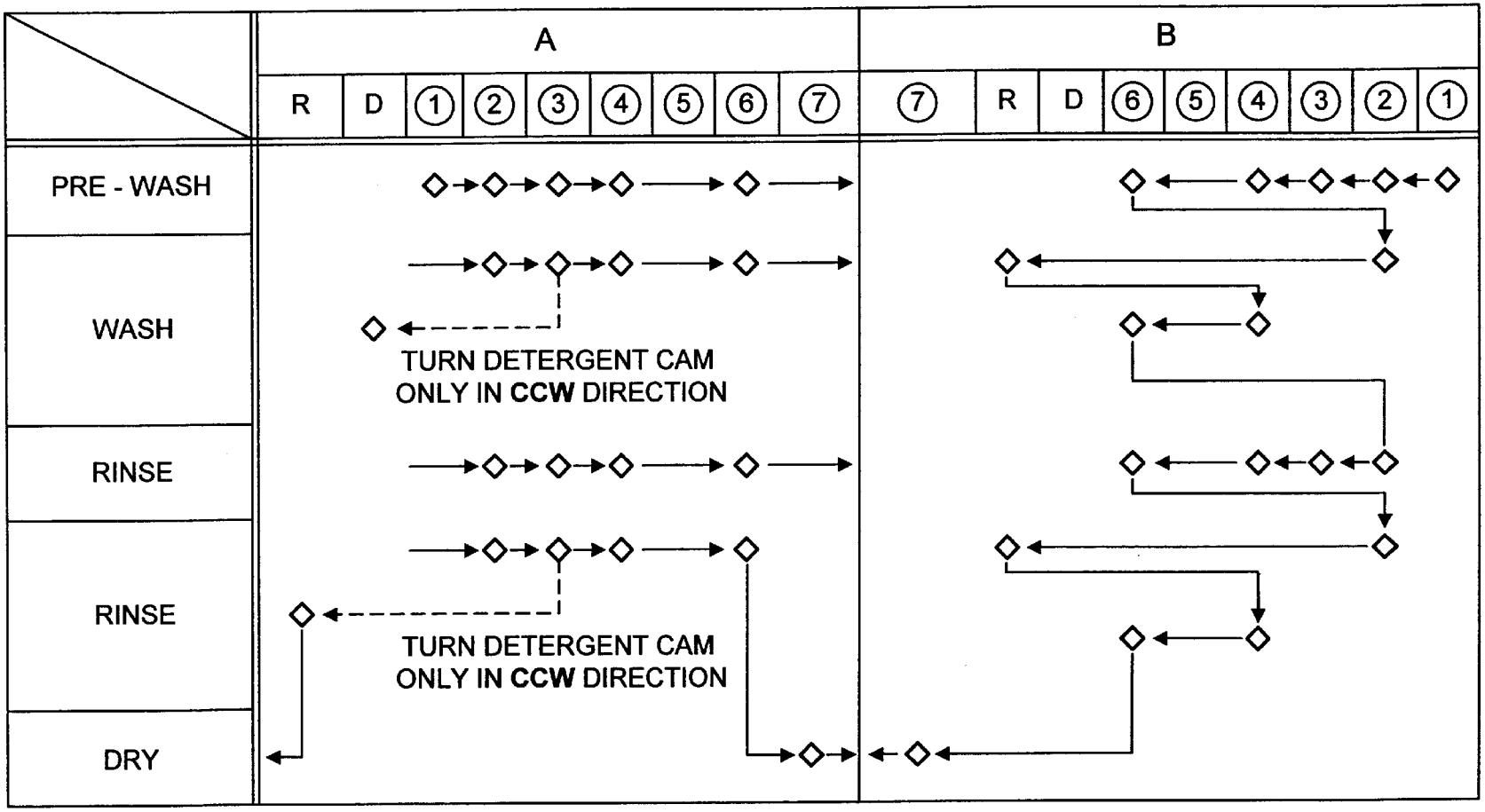
FIG. 8 presents a diagram which indicates the operating order of the sequence switch(es) in the case where the cam switch mechanism depicted in FIG. 1 is built into an automatic dishwasher.
Figure 9:
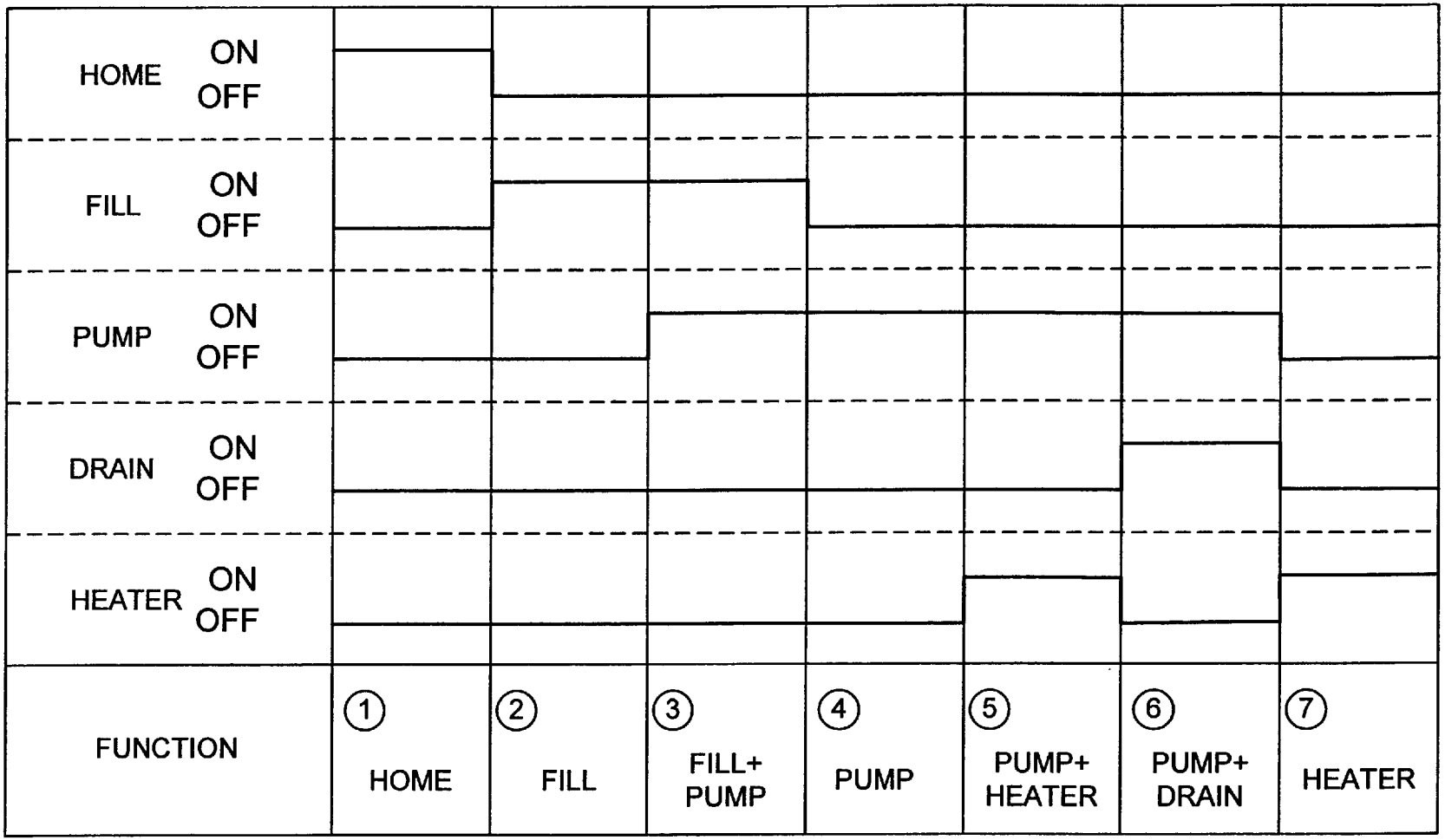
FIG. 9 presents a diagram which indicates the load timing of the sequence switches in the case where the cam switch mechanism depicted in FIG. 1 is built into an automatic dishwasher.

We next describe the action of the cam switch mechanism 1 when it is built into an automatic dishwasher, referring to FIGS. 7–9.

Into the control unit of the automatic dishwasher, that is, into the control unit of the cam switch mechanism, five different wash modes are programmed, as indicated in FIG. 7. The user selects the wash mode according to his or her objective. For example, when hot scrubber is selected, processes are executed in the order pre-wash process→wash process→rinse process→heater process. All of these processes are done in 107 minutes.

Now, the pre-wash process is conducted in three cycles, of 4 minutes, 4 minutes, and 5 minutes duration, respectively.

During these cycles of the pre-wash process, as indicated in the lefthand column A in FIG. 8, the stepping motor 2 is turned forward to perform the functions (1) then (2) then (3) then (4) then (6).

Each function is diagrammed in FIG. 9. Function (1), for example, is the HOME function, wherein the first home cam 7 turns the switching means 24 on. Function (3), moreover, is the FILL+PUMP function, wherein the first switch cam 3 turns the switching means 21 on, and the second switch cam 4 turns the switching means 22 on. The control unit controls the turning of the motor 2. More specifically, it performs each function for the pre-set time while stopping and restarting the turning of the motor 2 and varying its turning speed. Any explanation of other functions are omitted here.

Meanwhile, the wash process is performed in 43 minutes. The wash process, as shown in the lefthand column A in FIG. 8, turns the stepping motor 2 forward and performs the functions (2) then (3) then (4) then (6), and also turns the stepping motor 2 in reverse to turn the detergent cam and perform detergent deployment D.

The automatic dishwasher performs the other processes in the same manner and completes the washing program. The automatic dishwasher washes dishes, etc., automatically, performing the various processes in a designated order, corresponding, respectively, to the selected wash mode.

With the cam switch mechanism 1 configured as in this embodiment, the switch cams 3–5 and the detergent cam 6 are separate entities, with each cam engaged in one cam of a double ratchet.

Accordingly, when, for example, the motor 2 turns CW, only the detergent cam 6 turns; when the motor 2 turns CCW, only the switch cams 3–5 turn. By being configured in this way, it is possible to turn only the detergent cam without returning the switch cams 3–5, making it possible to prevent pump start-up noise, etc., that is produced when the switch cams 3–5 are turned backward. In other words, there is no need to return the switch cams 3–5, so there is no generation of pump start-up noise, etc.

Also, with the portion of the surface of the cams which do not affect the on/off of the switching means 21–25, or, in other words, with the portion where the switching state (on/off state) of the switching means 21–25 is not switched, the motor 2 can be stopped. Furthermore, the detergent cam 6 is set exclusively for detergent deployment (140° position) and rinse deployment (200° position). As indicated in FIG. 8, in actuality, the switching means perform detergent and rinse deployment during (FILL+PUMP).

Moreover, the morphology described in the foregoing is one example of a morphology well suited to this invention, but the invention is not limited to this; various modified embodiments are possible within a range wherein the essence of this invention is not lost.

For example, in the foregoing description, a stepping motor 2 is employed as the drive source, but this is not necessarily limited to a stepping motor. It could also be a DC motor, for example. Or, for the case of switch actions only, it could even be an AC motor.

Also, the mechanism which transmits the turning of the stepping motor 2 to each cam is not limited to that described above. For example, as with the cam switch mechanism 30 depicted in FIGS. 12–16, the turning of the stepping motor 2 could also be transmitted to the cams 35–39 via a first gear 31→a second gear 32→a third gear 33→a fourth gear 34.

In this case, the switch cams 35–37 and the home cam 38 are formed integrally, and these cams 35–38 are formed into a single unit with the detergent cam 39 by means of a screw. In other words, with this embodiment morphology, all of the cams 35–39 turn as a single unit, so one home cam suffices.

Furthermore, the first switch cam 35 corresponds to the FILL action and DRAIN action of the automatic dishwasher. Also, the second switch cam 36 corresponds to the PUMP action. The third switch cam 37 corresponds to the HEATER action. The home cam 38 detects the home position of these cams. In addition, the detergent cam 39 controls the detergent deployment timing and the rinse deployment timing.

Figure 17:
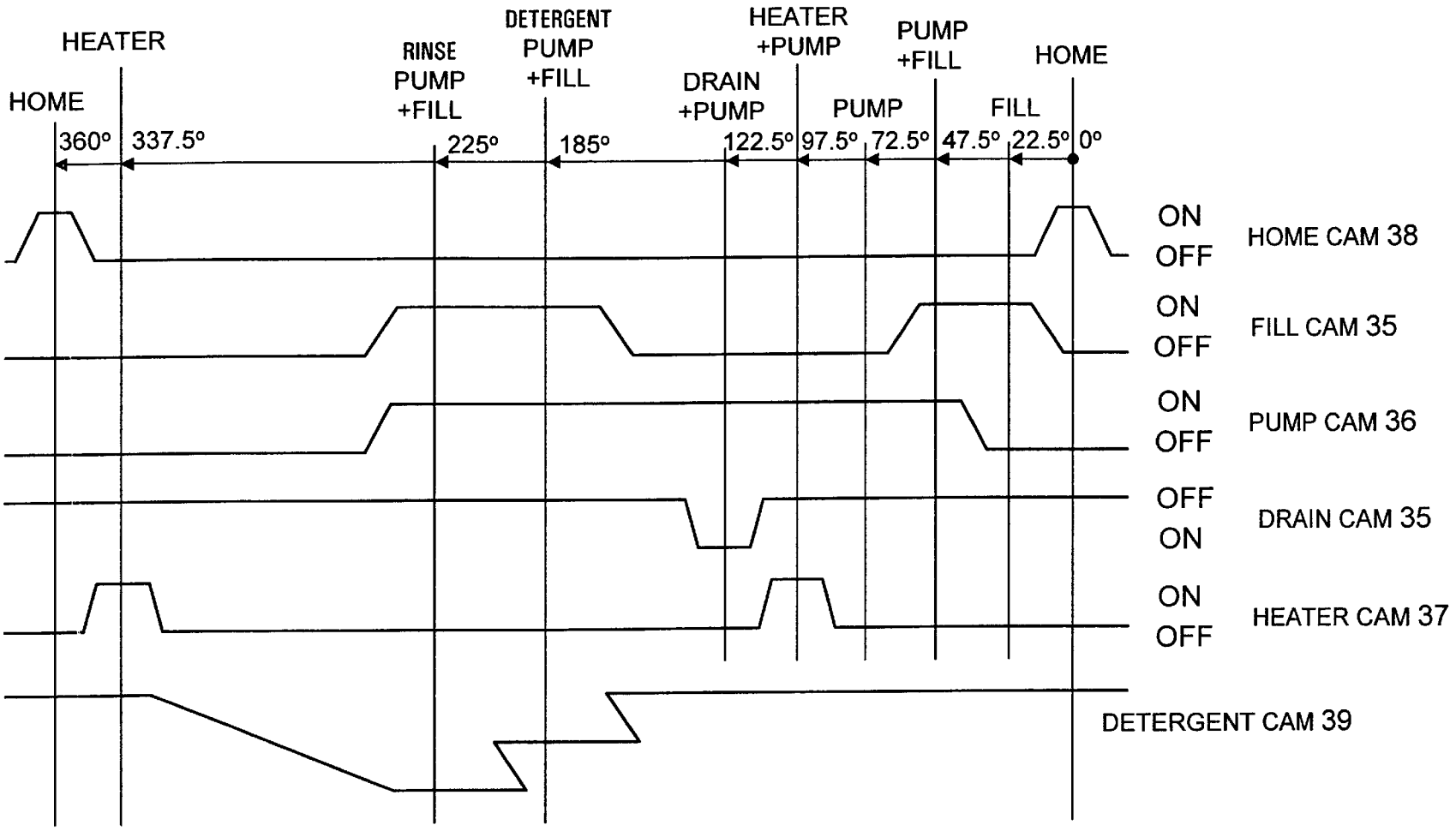

The cams 35–38 turn the corresponding switching means 40–43, respectively, on and off with the timing diagrammed in FIG. 17. Accordingly, even when structured in this manner, it is possible to automatically wash the dishes according to the wash mode selected, as indicated in FIG. 7, just as with the cam switch mechanism 1 described earlier. Moreover, the particulars of the processes when the cam switch mechanism 30 is employed are indicated in column B in FIG. 8. In this case, by turning the stepping motor 2 in reverse, it is possible to repeatedly perform functions already performed, or to pass over unnecessary functions without performing them.

More particularly, the various function regions are allocated to the region in the switch cams 35–37 from 0° to 122.5°. Also, the detergent cam 39 turns integrally with the switch cams 35–37, so that detergent deployment is performed when the detergent cam 39 is at 185°, and rinse deployment is performed when it is at 225°.

In the cam surfaces, the gradient is steep in the portions which connect the depressions with the protrusions, so that, in some cases, we cannot expect stable switching even when the switch makes contact. Even in such cases, however, with the cam switch mechanism of this invention, it is possible to control the electric current conducted to the switching means independently by a control means. Therefore, when a switching means contacts an unstable cam surface, the electric current can be cut off by the control means, so that stable switching can be performed such that unstable steep-gradient cam surfaces are not used.

Also, if control is effected with a specific cam surface so that no electric current goes to a switching means, it is possible to make the cams turn at high speed and pass over unnecessary functions without executing them, or to make the cams turn backward and execute the next function without executing unwanted functions.

As described in the foregoing, because the turning speed and turning direction of the cams are controlled by a control unit, and because the time during which the switching means are turned on and/or off can be set freely, it is possible to switch the switching means while turning the cams at high speed; on the other hand, it is possible, in cases where the switching means are not switched, to turn the cams at slow speed or to stop them. As a result, the long regions in the cam surfaces can be used to operate the switching means, thus improving the timing precision of the operational control of the switching means. Also, it is possible to operate the switching means using the cams, and to perform high-precision control without using the power relays that are necessary with conventional high-precision control, so that rising costs can be checked.

While the foregoing description and drawings represent the preferred embodiments of the present invention, it will be obvious to those skilled in the art that various changes and modifications may be made therein without departing from the true spirit and scope of the present invention.

What is claimed is:

1. A cam switch mechanism comprising:

(a) a drive source;

(b) a plurality of cams driven by said drive source;

(c) a plurality of switching means, responsive to contacting the cam surfaces of said plurality of cams, for switching the electrically conducting states of said plurality of switching means;

(d) a control unit for controlling a drive parameter of said drive source; whereby control of said drive parameter of said drive source by said control unit makes it possible to set positions of said plurality of cams as desired, and permits the electrically conducting states of said plurality of switching means to be freely set;

(e) wherein it is possible to combine and set a plurality of functions by combining the current conducting states of said plurality of cams and said plurality of switching means, wherein the turning speed of said cams is controlled by said control unit, and wherein the continuation time of said plurality of functions is freely set:

(f) wherein said control unit can operate said cams so that they turn forward or backward, and said plurality of functions can be selected in any order:

(g) wherein said control unit can switch the electric current conducted to said switching means independently of the switching of the current conducting state with said switching means contacting the cam surface of said cam;

(h) wherein said cams are made up of an action cam and a switch cam having an uneven part, and comprising an action member which causes a specific action to be performed by said action cam and a switching means that contacts the uneven part of said switch cam turning it on and off;

(i) said cam switch mechanism further comprising a transmission switching means between said drive source and said switch cam and said action cam, wherein separating said switch cam and said action cam such that due to said transmission switching means, said switch cam turns when said drive source turns forward, and such that said action cam turns when said drive source turns backward; and (j) wherein said transmission switching means is made a double ratchet, with one portion of said double ratchet linked to said switch cam and the other portion linked to said action cam such that said switch cam turns when said drive source turns forward, and said action cam turns when said drive source turns backward.

2. The cam switch mechanism of claim 1, wherein said control unit controls at least one of the drive direction, stopping and drive speed of the drive source.

3. The cam switch mechanism of claim 1, wherein said drive source is a stepping motor.

4. An automatic dishwasher incorporating the cam switch mechanism of claim 1.

* * * * *